US006019406A

United States Patent [19]

McDermott et al.

[11] Patent Number: 6,019,406

[45] Date of Patent: Feb. 1, 2000

[54] LIFTING-MACHINE POWER GRIPPER AND COMPONENTS

[75] Inventors: Daniel R. McDermott, Clinton; Harold D. McDermott; Lillian B. Reamy, both of Waldorf, all of Md.

[73] Assignee: McDermott, Rosanna C., Waldorf, Md.

[21] Appl. No.: 09/012,643

[22] Filed: Apr. 30, 1998

[51] Int. Cl.[7] ..... B66C 1/28

[52] U.S. Cl. ..... 294/81.51; 294/88; 294/67.31

[58] Field of Search ..... 294/65.5, 905, 294/106, 88, 81.1, 81.51, 81.61, 67.1, 67.31, 902

[56] References Cited

U.S. PATENT DOCUMENTS

| | | | |
|---|---|---|---|
| 1,931,700 | 10/1933 | Murphy et al. . | |
| 3,033,382 | 5/1962 | Noble et al. | 294/65 |
| 3,208,789 | 9/1965 | Barry . | |
| 3,572,808 | 3/1971 | Miller . | |
| 3,647,255 | 3/1972 | Hale et al. . | |
| 3,858,728 | 1/1975 | Fathauer | 294/81.1 |
| 4,238,169 | 12/1980 | DePriester et al. | 294/103.1 |
| 4,293,155 | 10/1981 | Grant . | |
| 4,671,724 | 6/1987 | Bolton | 294/81.51 |
| 4,687,244 | 8/1987 | Cullen et al. | 294/86.41 |
| 4,955,782 | 9/1990 | D'agnolo | 414/911 |
| 5,065,537 | 11/1991 | Bailey | 294/65.5 |
| 5,458,387 | 10/1995 | Conway et al. | 294/902 |
| 5,580,113 | 12/1996 | Pomerville et al. . | |
| 5,918,923 | 7/1999 | Killion | 294/902 |

FOREIGN PATENT DOCUMENTS

| | | | |
|---|---|---|---|
| 0138094 | 5/1990 | Japan | 294/905 |

*Primary Examiner*—Dean J. Kramer
*Assistant Examiner*—Paul Chin
*Attorney, Agent, or Firm*—Griffin, Butler, Whisenhunt & Szipl, LLP

[57] ABSTRACT

A power gripper for a lifting machine including a switching device coupled to a motor mounted on a frame of the power gripper by a flexible electric cord for operating a gripping element of the power gripper. The switching device includes a separate attaching device for attaching it to an item to be lifted, such as an electromagnetic. The reel mounted on the frame automatically reels in the flexible electric cord. The frame forms a positioning gauge.

24 Claims, 2 Drawing Sheets

FIG. 4
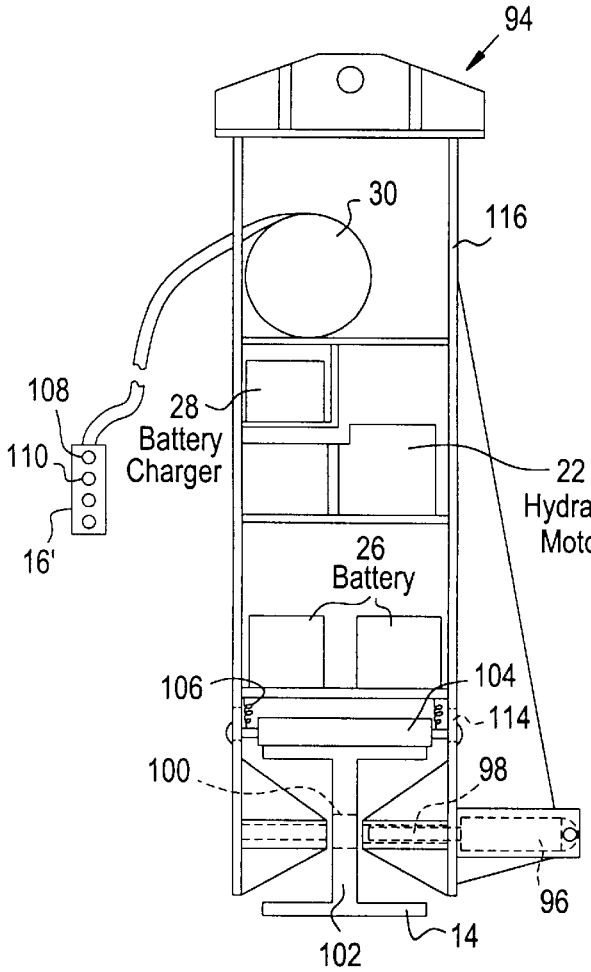
FIG. 5
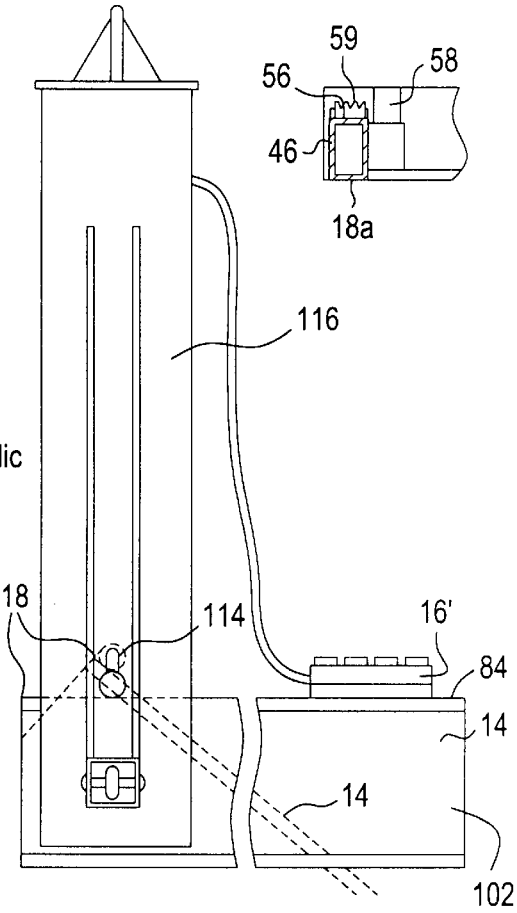
FIG. 6
FIG. 3
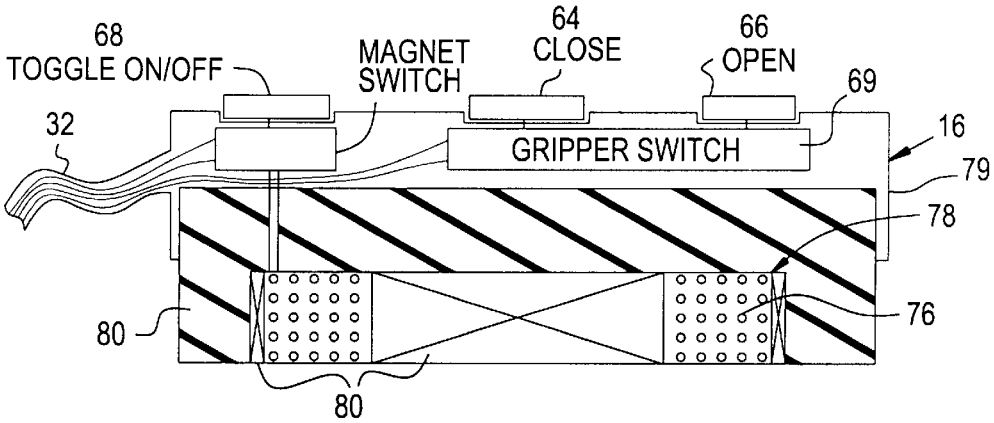

LIFTING-MACHINE POWER GRIPPER AND COMPONENTS

BACKGROUND OF THE INVENTION

This invention relates generally to large lifting equipment, such as cranes and the like, and more specifically to grippers, or grapples, which are on lifting machines, such as at the ends of crane cables, for attaching the lifting machines to items to be lifted.

As is well known, lifting machines, such as cranes and the like, are widely used at construction sites, as well as at other loading and unloading sites, for lifting heavy items, such as construction I-beams. A general problem that has often been encountered when such lifting machines have been detached from lifted items is that it has been necessary for workmen to position themselves at dangerous locations to do this. In this regard, for example, chokers have been commonly used at construction sites for attaching crane cables to construction beams, such as I-beams. These chokers have normally been in the form of sliding loops which tighten onto the I-beams. In order to properly loosen these chokers, it has been necessary for workmen to be physically located where the chokers are attached to the beams and to do it by hand. Quite often I-beams are placed in extremely dangerous locations where it is difficult and dangerous for workmen to release the chokers.

Thus, it is an object of this invention to provide a power gripper for lifting machines which can be disengaged from items to be lifted without a worker being positioned at a point of engagement. More specifically, it is an object of this invention to provide a power gripper which can be engaged and disengaged without requiring iron workers to go out onto beams, or climb vertical beams.

A number of prior-art devices have been suggested for accomplishing the above-stated objects. For example, U.S. Pat. No. 5,580,113 to Pomerville et al. describes a remote control crane/load safety shackle which includes a linear actuator for driving an actuator rod for supporting a load. A radio remote control unit can be used to selectively extend and retract a pin of the shackle. A major disadvantage of such a system is that construction sites have a great deal of machinery located thereat, including telephones, radios, and other equipment creating sparks, radio static and other interferes which cause malfunctions in radio remote control devices. If a power gripper is inadvertently caused to prematurely release, a falling load can cause a great deal of damage. U.S. Pat. No. 4,293,155 to Grant, and U.S. Pat. No. 3,647,255 to Hale et al., have similar teachings of radio-controlled power grippers. Therefore, it is another object of this invention to provide a lifting machine power gripper whose operation is extremely reliable and responsive only to signals fed thereto by authorized operators thereof.

Further, it is an object of this invention to provide components for machinery, such as lifting grippers.

It is also an object of this invention to provide a lifting power gripper which is easy and reliable to use, but yet which is reasonably inexpensive to construct.

SUMMARY

According to principles of this invention, a switching device of a power gripper is attached to the rest of the power gripper by a flexible electrical cord, with the switching device including an attaching device for attaching it to items to be lifted at positions which are easy for workers to reach.

According to one embodiment of the invention, the attaching device is an electromagnet which is powered by a same power source used for operating the power gripper.

The power gripper itself includes a frame with movable gripping elements attached thereto, with the frame holding a motivating device for moving the gripping elements and batteries for providing power to the motivating device and to the electromagnet of the switching device. There is also a reel on the frame for automatically reeling in the flexible electrical cord of the switching device when the switching device is not attached to an item to be lifted, or to some other item.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 3 is an enlarged cross-sectional view of a switching device of the power gripper depicted in FIG. 1;

FIG. 4 is a side view of an alternate-embodiment power gripper of this invention about to engage a beam;

FIG. 5 is an end, or edge, view of the alternate-embodiment power gripper of FIG. 4 lifting an end of the beam to place it in a vertical position; and FIG. 6 is a segmental cross-sectional view taken on line II–VI in FIG. 1.

DESCRIPTION OF THE PREFERRED EMBODIMENT

Figure 1:
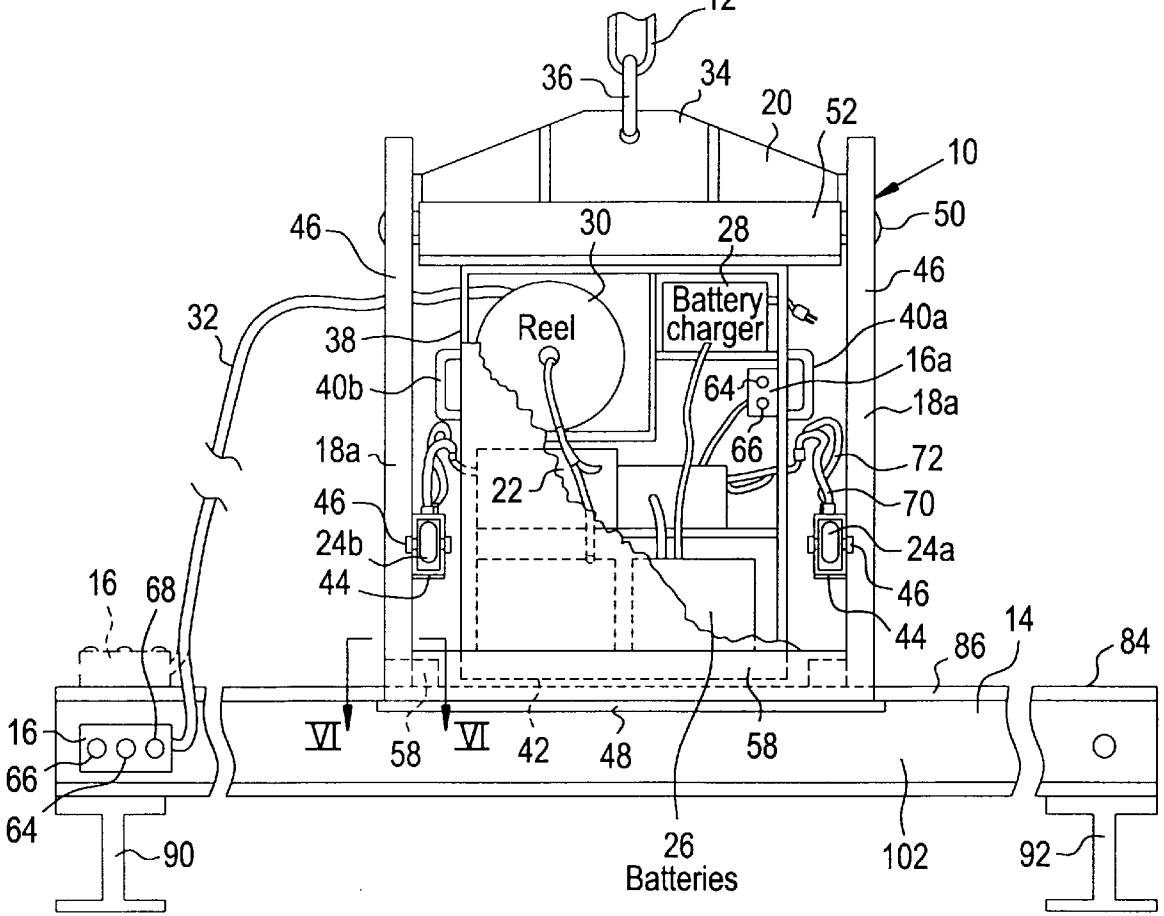
FIG. 1 is a side view of a power gripper of this invention engaging a steel I-beam which is resting on two other I-beams, with the power gripper being supported by a cable of a lifting machine.

A lifting-machine power gripper 10 is depicted in FIG. 1 being supported by a cable 12 of a crane (not shown) and being used to lift a steel I-beam 14. A switching device 16 of the power gripper 10 is used for controlling engaging and disengaging movements of pivoted gripping arms 18*a* and 18*b* of the power gripper 10. In addition to the switching device 16, the power gripper 10 comprises a frame 20, the gripping arms 18*a* and 18*b*, a hydraulic motor 22 as a motivating device, hydraulic cylinder/plungers 24*a* and 24*b*, batteries 26 as a power source, a battery charger 28 for recharging the batteries 26, and a reel 30 for rewinding a flexible electrical cord 32 with which the switching device 16 is coupled to the hydraulic motor 22 and the batteries 26.

Looking in more detail at the frame 20, the frame 20 has at its upper end a reinforced attachment plate 34 for attaching the frame 20 to the lifting machine cable 12 via a link 36. Rigidly attached to the attachment plate 34, as part of the frame 20, is a shelf case 38 which includes compartments for supporting the hydraulic motor 22, the batteries 26, the battery charger 28, and the reel 30. In addition, the shelf case 38 has handles 40*a* and 40*b* at its opposite ends and it also supports a secondary switching device 16*a*.

The shelf case 38 further defines a positioning gage bottom 42 on a bottom edge thereof whose purpose will be described below with the operation of the invention.

Figure 2:
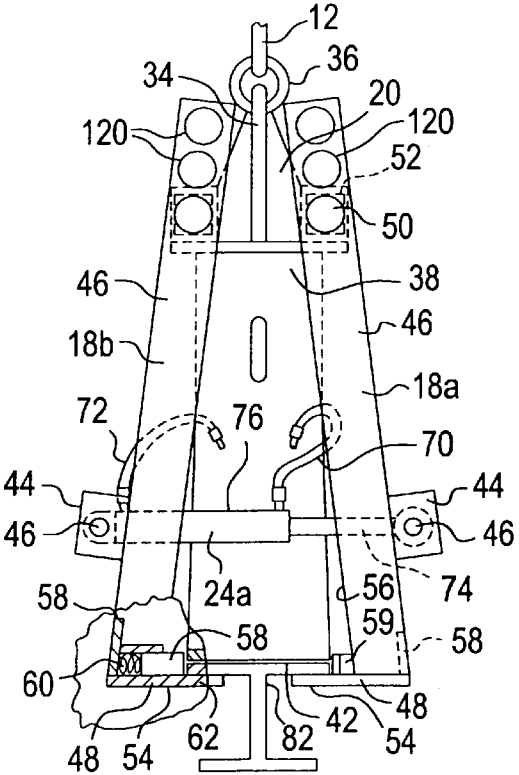
FIG. 2 is an end view of the structure depicted in FIG. 1, except the supporting I-beams are not shown in this view.

The hydraulic motor 22 can be of a type sold by Fenner Fluid Power as Model 4Z339D, which is a 12 volt hydraulic unit. In an embodiment that is presently preferred, a hydraulic cylinder of Miller Fluid Power, of Bensenville, Ill., Model 4Z634B is used as each of the hydraulic cylinder/plungers 24*a, b*. This hydraulic cylinder has a stroke of 6 inches and provides a force of 2500 lbs. As can be seen in FIGS. 1 and 2, each of these hydraulic cylinder/plungers 24*a, b* is pivotally attached at its respective opposite ends to the gripping arms 18*a* and 18*b*. In this regard, there are boxes 44 welded to inside surfaces of the arms 18*a* and 18*b*. The hydraulic cylinder-plungers 24*a* and 24*b* are mounted inside these boxes 44 by swivel pins 46 which allow the hydraulic cylinder/plungers 24*a* and 24*b* to pivot relative to the gripping arms 18*a* and 18*b*. The boxes 44 also protect the cylinder/plungers 24*a* and 24*b*.

Looking now in more detail at the gripping arms 18*a* and 18*b*, each of these arms has a squared U-shape, with free-end lever portions 46 and a base portion 48. The lever portions 46 are pivotally attached at their free ends to the frame 20 by shafts 50 which are welded to the free-end lever portions 46 and which rotate in bearing frame members 52. Each of the base portions 48 has a horizontal claw 54 which extends inwardly beyond side surfaces 56 of the lever portions 46, to which the horizontal claw is attached. In this regard, the claw 48 is attached to the lower ends of the lever portions 46 and includes a brace 58 which is also welded to the lever portions 46. Mounted on the base portion 48 are spring-loaded pushers, or retainers, 58 which are pushed outwardly by springs 60 to extend to inside edges 62 of the claws 54. The purpose of the pushers 58 will be described with the operation of the invention below.

In addition to the pushers 58, hardened-steel teeth 59 (FIG. 6) are attached at the inside surface 56 of each of the lever portions 46 to bite into the I-beam 14, for positively holding the I-beam 14 against lengthwise movement as is described below.

Looking now in more detail at the reel 30, this reel is spring biased to automatically reel in the flexible electrical cord 32 of the switching device 16 if the switching device 16 is not attached to, or otherwise held by, something which is spaced from the frame 20. The reel 30 is electrically coupled to the batteries and to the hydraulic motor 22 so that the switching device 16 can be powered by the batteries 26 and can be used to control operation of the hydraulic motor 22. The secondary switching device 16*a*, which is rigidly attached to the frame 20, is also in communication with the hydraulic motor 22 for controlling operation of the hydraulic motor 22, but it does not need a separate attachment to the batteries 26. A number of electrical reels are currently available which will perform these functions, but the one which is used in a preferred embodiment of the invention is manufactured by Daniel Woodhead Co. under Model No. 9394.

The battery charger 28 is one sold by MARINCO as Model No. 150BBI, however, many other battery chargers could also be used. The battery charger 28 has an electrical plug so that it can be plugged in, at night for example, for charging the batteries 26.

The switching device 16 is shown in more detail in FIG. 3. In the depicted embodiment, the switching device 16 has three push-button switch actuators as follows: A gripper-close button 64, a gripper-open button 66, and an electromagnet on/off toggle button 68.

The gripper-close button 64 and the gripper-open button 66 operate a gripper switch 69 which communicates with the hydraulic motor 22. When the gripper-close button 64 is pushed, the gripper switch 69 operates the hydraulic motor 22 to pressurize hydraulic lines 70 and to reduce pressure on hydraulic lines 72. This causes plungers 74 to move into the cylinders 76 of the hydraulic cylinder/plunger mechanisms 24*a* and 24*b*. This, in turn, causes the gripping arms 18*a* and 18*b* to pivot toward one another for engaging the I-beam 14, as depicted in FIG. 2.

Similarly, when an operator depresses the gripper-close button 64, the hydraulic motor 22 is caused, via the gripper switch 69, to pressurize fluid at the hydraulic lines 72 and reduce pressure of fluid at the hydraulic lines 70 to thereby cause the gripping arms 18*a* and 18*b* to pivot away from one another on the frame 20.

When the electromagnet toggle on/off button 68 is depressed once by an operator, electric current is caused to flow from the batteries 26, through a coil 76 of an electromagnet 78 in a switch housing 79. The electromagnet 78, in addition to the coil 76, also includes pole pieces 80 to enhance flow of flux about the coil 76. When the electromagnet toggle on/off button 68 is depressed a second time, current to the coil 76 is turned off. Thus, alternate depressions of the electromagnet toggle on/off button 68 toggles on and off the electromagnet 78. The electromagnet is surrounded by a rubber mount 80 for its protection, as will be further explained below.

Describing now operation of the first-embodiment power gripper 10 of FIGS. 1–3, the cable 12 of the lifting machine is attached to the link 36 for lifting the power gripper 10. Before the power gripper 10 is used to lift something, the reel 30 will be in a "reeled in" condition in which the flexible electrical cord 32 is reeled in because of a spring biasing of the reel 30. Thus, the switch device 16 is positioned close to the shelf case 38 of the frame 20. To pickup the steel I-beam 14 with the Power gripper 10, a lifting-machine operator of the lifting machine moves the lifting machine to position the power gripper 10 over the I-beam 14 and then extends the cable 12 to thereby lower the power gripper 10 onto the I-beam 14 with the gripping arms 18*a, b* open. An attaching operator located at the I-beam 14 helps guide the power gripper 10 using the handles 40*a* and 40*b*. As the attaching operator helps guide the power gripper 10 he also ensures that the gripping arms 18*a* and 18*b* are rotated outwardly, away from one another, to open a mouth 82 between inside edges 62 of the claws 54. To do this, he depresses the gripper-open button 66 on the secondary switching device 16*a*. As the attaching operator helps guide the power gripper 10 onto the I-beam 14, the positioning gage bottom 42 of the shelf case 38 eventually comes into contact with a top surface 84 of the I-beam 14. When this occurs, the attaching operator knows that the power gripper 10 is in a proper position for gripping the I-beam 14. The attaching operator then depresses the gripper-close button 64 on the secondary switching device 16*a*. Depression of the gripper-close button 64 causes the hydraulic motor 22 to contract the hydraulic cylinder/plungers 24*a* and 24*b* to thereby pivot the base portions 48 of the gripping arms 18*a* and 18*b* toward one another so that the claws 54 extend under a top web 86 of the I-beam 14 and the teeth 5*a* bite into lateral edges of the top web 86. The gripping arms 18*a* and 18*b* are pulled toward one another with a force of 2500 pounds. As the claws 54 extend below the top web 86 of the I-beam 14, the pushers 58 are pushed, or retreat back against forces of springs 60, by edges of the top web 86 of the I-beam 14. Tests have shown that it would take a lengthwise force greater than 10,000 lbs. on the I-beam 14 relative to the power gripper 10, to pull the I-beam 14 lengthwise from the gripper.

Once the claws 54 are firmly positioned below the top web 86, and the teeth 59 are biting into the to web 86, fail-safe solenoids (not shown) in lines between the hydraulic motor 22 and the hydraulic cylinder-plungers 24*a* and 24*b* are closed to thereby lock the lines 70, 72 to the hydraulic cylinder/plungers. These fail-safe solenoids are not depicted in the drawings for purposes of simplicity. In any event, by locking these lines, the gripping arms 18*a* and 18*b* are locked in the closed position and will not open even if the hydraulic motor 22 malfunctions. These fail-safe solenoids are biased to a normally closed position, and only open when the hydraulic motor 22 is actively trying to open or close the gripping arms 18*a* and 18*b*. Thus, the gripping arms 18*a* and 18*b* are always locked in either the opened or closed positions, unless they are being moved between these two positions. Provisions are made for manually unlocking the lines should that become necessary (in one embodiment this is done by adding an extra valved line running back to the hydraulic motor 22 which can be manually valved open for relieving pressure), but these provisions are also not shown in the drawings for the sake of simplicity.

Now the attaching operator grips the switching device 16 and pulls it away from the shelf case 38, which is allowed by rotation of the reel 30. The attaching operator positions the switching device 16 on the I-beam 14 at a place which will be accessible to a detaching operator once the I-beam is moved by the moving machine to a new position, for example, at a left end of the I-beam as is shown in FIG. 1 (two possible positions being shown, one solid and one dased). The attaching operator then depresses the electromagnet toggle on/off button 68. When the attaching operator does this, the magnet switch 66 furnishes power to the coil 76 of the electromagnet 78, thereby activating the electromagnet 78. The electromagnet 78 then holds the switching device 16 securely on the I-beam 14 at this location chosen by the attaching operator. The electromagnet 78 continues to be energized so that the switching device is held to the I-beam 14 until the electromagnet toggle on/off button 68 is again depressed.

The lifting-machine operator then causes the lifting machine to lift the cable 12 to thereby lift the power gripper 10 and the I-beam 14 to which the power gripper 10 is engaged. The lifting-machine operator manipulates controls of the lifting machine, such as a crane, to move the power gripper 10, and the gripped I-beam 14 to a new location, for example, to place the I-beam on previously-installed I-beams 90 and 92, high on a building frame. Once the I-beam 14 is securely supported by the previously-installed I-beams, a detaching operator at that location, who has relatively easy access to the switching device 16 at the left end of the I-beam 14, can then depress the electromagnet toggle on/off button 68 to turn the electromagnet 78 off so that he can remove it from the I-beam 14. If the detaching operator does this, he continues to hold the switching device 16 in his hand so that it is not automatically reeled in by the reel 30. In any case, the detaching operator then depresses the gripper-open button 66 thereby causing the hydraulic motor 22 to extend the hydraulic cylinder/plungers 24*a* and 24*b* and separate the gripping arms 18*a* and 18*b*.

In order to ensure that the claws 54 retract from under the top web 86 of the I-beam 14 as the gripping arms 18*a* and 18*b* separate, the pushers 58 push against edges of the top web 86 until outer ends of the plungers 58 align with inside edges 62 of the claws 54. Thus, wind blowing against the power gripper 10, or an improper alignment of the cable 12 above the I-beam 14, will not be allowed to keep the claws 54 under the top web 86. Once the gripping arms 18*a* and 18*b* are fully separated, and the mouth 82, is therefore open, the lifting-machine operator lifts the power gripper 10 upwardly away from the I-beam 14. Before this is done, however, or simultaneously therewith, the detaching operator releases the switching device 16 and it is automatically reeled in by a spring in the reel 30.

The power gripper 10 is then moved by the lifting-machine operator to the next I-beam, or other item, to be lifted.

FIGS. 4 and 5 depict an alternate embodiment of this invention. This embodiment is mainly used for placing beams in vertical-column positions. In addition to having a more elongated shape, a power gripper 94 of this embodiment differs mainly from the power gripper 10 of the FIGS. 1 and 2 embodiment in that instead of having pivotal arms 18*a* and 18*b*, it has a single hydraulic cylinder/plunger 96 for engaging an I-beam 14. The power gripper 94 engages the I-beam 14 by extending a plunger 98 through a hole 100 in an interior web 102 of the I-beam 14. Often, this is done with the power gripper 94 in a vertical configuration, but with the I-beam 14 lying horizontally, as depicted in FIGS. 4 and 5. Instead of using a positioning gage bottom 42 of a shelf case, as in the FIGS. 1 and 2 embodiment, the FIG. 4 embodiment has a spring biased positioning roll 104. Springs 106 hold the positioning roll 104 at a position at which the plunger 98 is adjacent the hole 100 when the positioning roll 104 contacts the top surface 84 of the I-beam 14.

A switching device 16' of the FIG. 4 embodiment is slightly different from the switching device 16 of the FIG. 1 embodiment in that the switching device 16' has four buttons rather than three. In the switching device 16', the toggle on/off button 68 is replaced by two buttons, namely, a magnet-on button 108 and a magnet-off button 110. The switching devices 16 and 16' are interchangeable in the embodiments.

It should be understood that the embodiment of FIGS. 4 and 5 can also include handles such as the handles 40*a* and 40*b* of the FIG. 1 embodiment and can also include a secondary switching device 16*a*, of the type shown in the FIG. 1 embodiment.

In any event, once an attaching operator has ensured that the power gripper 94 is properly aligned with the I-beam 14, he actuates the hydraulic motor 22 to extend the plunger 98 through the hole 100. On the opposite side of the hole 100 the plunger 98 enters into a support bore 112 of a power-gripper frame 116. The attaching operator then depresses the magnet-on button 108 to activate the electromagnet 78 of the switching device 16' and places the switching device 16' at a position on the I-beam 14 which can be easily accessed by a detaching operator. A lifting-machine operator then lifts the power gripper 94 and the I-beam 14 which it grips. As this is done, the I-beam 14 rotates relative to the power gripper 94 about the plunger 98 as is shown in dashed lines in FIG. 5. This rotation causes the positioning roll 104 to move upwardly in slots 114 of the frame 116 against force of the springs 106 so that the positioning roll 104 can clear a corner 118 of the I-beam 14 as the corner passes the positioning roll 104.

Often, when beams are lifted in this manner, the beams are eventually placed in vertical positions. In such cases, the switching device 16' would normally be electromagnetically adhered to the I-beam 14 by an attaching operator at a position on the I-beam which will be lower than the position at which the power gripper 94 engages the I-beam 14. Thus, a detaching operator can easily access the switching device 16' for using the buttons thereof to retract the plunger 98 from the I-beam 14 and for deactivating the electromagnet 78 so that the switching device 16' is released from the I-beam 14. Once the detaching operator releases the switching device 16' the reel 30 then automatically reels it in.

It should be recognized by those of ordinary skill in the art that the attaching device, with which the switching device is selectively attached to the item being lifted, along with the automatically-retractable reel, offer tremendous advantages. The attaching device allows the switching device to be placed on the lifted item at a location at which the detaching operator can easily access it without risking his life.

Further, by using an electric magnet as the attaching device, the attaching operator and the detaching operator can easily and quickly attach and detach the switching device. However, other attaching devices could also be used.

Further, since the switching device is physically coupled to the motivating device, namely, to the hydraulic motor, communication between these two elements is completely reliable and not affected by surrounding electromagnetic signals and static.

It is also beneficial to surround the electromagnet of the switching device with a rubber casing in order to protect the electromagnet from damage when the switching device is reeled in or during other operations.

It is also beneficial that the power gripper of this invention includes a gripper gage which engages items to be lifted for properly positioning jaws, claws, plungers or other engaging members of the power gripper.

The pushers 58 of this invention for ensuring that the claws 58 clear the top web 86 of the I-beam being lifted are highly beneficial because they ensure that a detaching operator need not hand-manipulate the power gripper to release an item being lifted.

The self-retracting reel is also beneficial because it prevents the switching device from remaining extended and thereby possibly becoming damaged, damaging other things, or injuring someone.

While the invention has been particularly shown and described with reference to a preferred embodiment, it will be understood by those skilled in the art that various changes in form and detail may be made therein without departing from the spirit and scope of the invention.

For example, the claws 54 of the first embodiment could have many forms to fit many different shapes of items to be lifted. Further, it would be possible to have adapters which attach to the base portions 48 of the gripping arms 18*a* and 18*b* for gripping various types of objects. One could have adapters which attach to the base portions 48, for example, which are shaped to engage and lift pipes. Another adapter could be used for lifting roof rafters. Yet another could be shaped for lifting blocks, or stacked containers.

In one example of the embodiment of FIGS. 1 and 2, the frame 20 is approximately 40 inches wide so that the lever portions 46 of the gripping arms 18*a* and 18*b* are spaced approximately 40 inches from one another. The lever portions 46 are each approximately 48 inches long from its top to its claw 54. However, it will be understood by those of ordinary skill in the art that other dimensions could also be used. In fact, in the embodiment of FIGS. 1 and 2 the levers 46 have additional adjustment holes 120 therein for receiving the shafts 50 in order to adjust the power gripper 10 for lifting I-beam with Neslon Studs (studs extending from I-beam top webs for becoming embodied in concrete).

In an example of the embodiment of FIGS. 4 and 5, the frame 116 is approximately 18 inches wide and 68 inches tall, however, other dimensions would also work for carrying out various functions.

Similarly, in the embodiment of FIGS. 1 and 2 the plunger 4 has an 8 inch throw, whereas in the Embodiment of FIGS. 4 and the plunger 98 was a 6 inch throw. Again, however, power grippers could be built within this invention with plungers having different dimensions and movements than these.

In one example of the embodiment of FIGS. 1 and 2, there are two pushers 58 located at respective ends of each base portions 48. However, it would be possible to have a single pusher which extends a long distance along each of the base portions 48.

At night, or at other times when the power gripper is not in use, the plug of the battery charger 28 is plugged into a power source so that the battery charger 28 can recharge the batteries.

Although the power gripper of this invention is specifically shown herein lifting I-beams, it should be understood that it could be used for lifting anything it can grip. Also, the power gripper itself could be configured quite differently than the power grippers specifically shown herein, within the scope of the invention. Such power grippers can be manufactured for lifting all weights of beams.

The invention claimed is:

1. A power gripper for a lifting machine for gripping an item to be lifted by the lifting machine, said power gripper comprising:

a frame for engaging the lifting machine via a lifting-machine cable to be thereby raised and lowered by the lifting machine;

at least one gripping element movably mounted on the frame for moving between a gripping position in which it grips the item to be lifted and a releasing position in which it releases the item to be lifted;

a motivating means mounted on the frame for selectively moving the at least one gripping element between the gripping and releasing positions; and, a switching device coupled to the motivating means and the frame substantially only by a flexible electrical cord extending from the switching device to the motivating means so that said switching device has freedom of movement relative to the frame as allowed by flexibility and length of the flexible electrical cord so that an operator located at the item to be lifted can move the switching device relative to the frame and item to be lifted.

2. A power gripper for a lifting machine as in claim 1, wherein said switching device includes an attaching device for attaching said switching device to said item to be lifted.

3. A power gripper for a lifting machine as in claim 2, wherein said attaching device is a magnet.

4. A power gripper for a lifting machine as in claim 3, wherein there is a power source supported by said frame and said magnet is an electromagnet which receives electrical power from the power source through the flexible electrical cord.

5. A power gripper for a lifting machine as in claim 4, wherein said power source includes a battery and said motivating means receives its power from said battery.

6. A power gripper for a lifting machine as in claim 5, wherein said frame further supports a battery charger to be used for charging said battery.

7. A power gripper for a lifting machine as in claim 5, wherein said motivating means is a hydraulic motor powered by energy received from said battery.

8. A power gripper for a lifting machine as in claim 3, wherein said switching device includes a resilient casing for the magnet.

9. A power gripper for a lifting machine as in claim 1, wherein said frame includes a positioning gage for contacting the item to be lifted and thereby positioning the gripping element relative to the item to be lifted so that the motivating means can move the gripping element into the gripping position on said item to be lifted.

10. A power gripper for a lifting machine as in claim 9, wherein the positioning gage has freedom of movement relative to other parts of the frame for allowing rotation of the item to be lifted once the lifting machine begins lifting.

11. A power gripper for a lifting machine as in claim 9, wherein the positioning gage is at a bottom of a shelf case forming part of the frame for holding the motivating means.

12. A power gripper for a lifting machine as in claim 11, wherein said shelf case also holds a reel for automatically reeling in said flexible electrical cord.

13. A power gripper for a lifting machine as in claim 1, wherein a reel is further included mounted on said frame for automatically reeling in said flexible electrical cord.

14. A power gripper for a lifting machine as in claim 13, wherein said reel is spring-loaded for automatically reeling in said flexible electrical cord and for allowing said flexible electrical cord to be forcibly reeled out.

15. A power gripper for a lifting machine as in claim 1, wherein said power gripper comprises at least one swivel arm on the frame with a laterally extending claw for engaging below the item to be lifted and wherein is further included a spring-loaded pusher on the arm for pushing the item to be lifted from the claw when the power gripper is moved to the releasing position.

16. A power gripper for a lifting machine for gripping an item to be lifted by the lifting machine, said power gripper comprising:

a frame for engaging the lifting machine to be thereby raised and lowered by the lifting machine;

two opposite gripping arm elements mounted on the frame for movement, relative to the frame and to each other, toward and away from one another for moving between a gripping position in which the gripping arm elements move toward one another to grip between them, the item to be lifted, and a releasing position in which the gripping arm elements move apart to release the item to be lifted;

a motivating means mounted on the frame for selectively moving the gripping arm elements between the gripping and releasing positions;

wherein said frame supports batteries and the motivating means; and wherein said frame further includes a positioner located between the gripper arm elements for coming into contact with a top surface of the item to be lifted located between the gripping arm elements and thereby properly positioning the gripping arm elements for gripping the item to be lifted when in the gripping position.

17. A power gripper for a lifting machine as in claim 16, wherein the positioner has freedom of movement relative to other parts of the frame for allowing rotation of the item to be lifted once the lifting machine begins lifting.

18. A power gripper for a lifting machine as in claim 16, wherein the positioner is a bottom of a shelf case forming part of the frame for holding the motivating means.

19. A power gripper for a lifting machine for gripping an item to be lifted by the lifting machine, said power gripper comprising:

a frame for engaging the lifting machine to be thereby raised and lowered by the lifting machine;

at least one gripping element movably mounted on the frame for moving between a gripping position in which it grips the item to be lifted and a releasing position in which it releases the item to be lifted;

a motivating means mounted on the frame for selectively moving the at least one gripping element between the gripping and releasing positions; and a switching device coupled to the motivating means by a flexible electrical cord so that said switching device has freedom of movement relative to the frame as allowed by flexibility and length of the flexible electrical cord;

wherein said switching device includes an attaching device for attaching said switching device to said item to be lifted.

20. A power gripper for a lifting machine for gripping an item to be lifted by the lifting machine, said power gripper comprising:

a frame for engaging the lifting machine to be thereby raised and lowered by the lifting machine;

at least one gripping element movably mounted on the frame for moving between a gripping position in which it grips the item to be lifted and a releasing position in which it releases the item to be lifted;

a motivating means mounted on the frame for selectively moving the at least one gripping element between the gripping and releasing positions; and a switching device coupled to the motivating means by a flexible electrical cord so that said switching device has freedom of movement relative to the frame as allowed by flexibility and length of the flexible electrical cord;

wherein said frame includes a positioning gage for contacting the item to be lifted and thereby positioning the gripping element relative to the item to be lifted so that the motivating means can move the gripping element into the gripping position on said item to be lifted.

21. A power gripper for a lifting machine for gripping an item to be lifted by the lifting machine, said power gripper comprising:

a frame for engaging the lifting machine to be thereby raised and lowered by the lifting machine;

at least one gripping element movably mounted on the frame for moving between a gripping position in which it grips the item to be lifted and a releasing position in which it releases the item to be lifted;

a motivating means mounted on the frame for selectively moving the at least one gripping element between the gripping and releasing positions; and a switching device coupled to the motivating means by a flexible electrical cord so that said switching device has freedom of movement relative to the frame as allowed by flexibility and length of the flexible electrical cord;

wherein a reel is further included mounted on said frame for automatically reeling in said flexible electrical cord.

22. A power gripper for a lifting machine for gripping an item to be lifted by the lifting machine, said power gripper comprising:

a frame for engaging the lifting machine to be thereby raised and lowered by the lifting machine;

at least one gripping element movably mounted on the frame for moving between a gripping position in which it grips the item to be lifted and a releasing position in which it releases the item to be lifted;

a motivating means mounted on the frame for selectively moving the at least one gripping element between the gripping and releasing positions; and, a switching device coupled to the motivating means by a flexible electrical cord so that said switching device has freedom of movement relative to the frame as allowed by flexibility and length of the flexible electrical cord;

wherein said power gripper comprises at least one swivel arm on the frame with a laterally extending claw for engaging below the item to be lifted and wherein is further included a spring-loaded pusher on the arm for pushing the item to be lifted from the claw when the power gripper is moved to the releasing position.

23. A power gripper for a lifting machine for gripping an item to be lifted by the lifting machine, said power gripper comprising:

a frame for engaging the lifting machine to be thereby raised and lowered by the lifting machine;

at least one gripping element movably mounted on the frame for moving between a gripping position in which it grips the item to be lifted and a releasing position in which it releases the item to be lifted;

a motivating means mounted on the frame for selectively moving the at least one gripping element between the gripping and releasing positions;

wherein said frame supports batteries and the motivating means; and wherein said frame further includes a positioner for coming into contact with an item to be lifted and thereby properly positioning the at least one gripping element for gripping the item to be lifted;

wherein the positioner has freedom of movement relative to other parts of the frame for allowing rotation of the item to be lifted once the lifting machine begins lifting.

24. A power gripper for a lifting machine for gripping an item to be lifted by the lifting machine, said power gripper comprising:

a frame for engaging the lifting machine to be thereby raised and lowered by the lifting machine;

at least one gripping element movably mounted on the frame for moving between a gripping position in which it grips the item to be lifted and a releasing position in which it releases the item to be lifted; and a motivating means mounted on the frame for selectively moving the at least one gripping element between the gripping and releasing positions;

wherein said frame supports batteries and the motivating means; and wherein said frame further includes a positioner for coming into contact with an item to be lifted and thereby properly positioning the at least one gripping element for gripping the item to be lifted;

wherein the positioner is a bottom of a shelf case forming part of the frame for holding the motivating means.

* * * * *